US011705291B1

(12) United States Patent
Stevens

(10) Patent No.: US 11,705,291 B1
(45) Date of Patent: Jul. 18, 2023

(54) SWITCH GUARD FOR A POWER TOOL

(71) Applicant: Robert Bosch GmbH, Stuttgart (DE)

(72) Inventor: James B. Stevens, Oak Park, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/556,677

(22) Filed: Dec. 20, 2021

(51) Int. Cl.
*H01H 9/28* (2006.01)
*B25F 5/02* (2006.01)

(52) U.S. Cl.
CPC ..... *H01H 9/287* (2013.01); *B25F 5/02* (2013.01); *H01H 2300/024* (2013.01)

(58) Field of Classification Search
CPC .. H01H 9/287; H01H 2300/024; H01H 23/04; H01H 23/14; H01H 9/00; H01H 67/00; B25F 5/02; B25F 5/00
USPC ..... 200/43.16, 341–345, 400; 174/67
See application file for complete search history.

(56) References Cited

U.S. PATENT DOCUMENTS

| | | | | |
|---|---|---|---|---|
| 2,141,936 | A | 12/1938 | Schmitt | |
| 5,999,072 | A | 12/1999 | Slavik | |
| 7,521,642 | B2 | 4/2009 | Belanger | |
| 10,418,199 | B2 | 9/2019 | Lee et al. | |
| 2006/0011361 | A1* | 1/2006 | Shimma | H01H 9/06 173/48 |
| 2011/0198200 | A1 | 8/2011 | Drabik | |

* cited by examiner

*Primary Examiner* — Edwin A. Leon
*Assistant Examiner* — Iman Malakooti
(74) *Attorney, Agent, or Firm* — Charles Wesley Duncan, Jr.; Maginot, Moore & Beck LLP

(57) ABSTRACT

This disclosure relates to a switch guard that prevents inadvertent pressing by a user of the direction-control switch of a handheld power tool. On each side of the housing of the tool, a pair of protrusions extend from the housing, one just to the front of the switch and one just to the rear. Whether the power tool is being operated right- or left-handed, the protrusions prevent a user's thumb or forefinger from inadvertently pressing the direction-control switch while the tool is in operation.

1 Claim, 4 Drawing Sheets

SWITCH GUARD FOR A POWER TOOL

TECHNICAL FIELD

This disclosure relates to a switch guard for a handheld power tool with a direction-control switch slidable through the housing of the tool. On each side of tool, a pair of protrusions extend from the housing, one just to the front of the direction-control switch and one just to the rear of the direction-control switch. Whether the tool is being operated right- or left-handed, the protrusions help prevent a user's thumb or forefinger from inadvertently pressing the direction-control switch while the tool is in operation.

BACKGROUND

To allow one-handed operation, the direction-control switch of a handheld power tool is typically located in close proximity to the user's thumb on one side of the tool and forefinger on the opposite side. However, such an arrangement commonly leads to inadvertent pressing of the direction-control switch by the user while the tool is operation, which is disruptive and potentially unsafe to the user. Accordingly, there is a need for a switch guard for a handheld power tool that helps prevent the user from inadvertently pressing the direction-control switch.

SUMMARY

One aspect of this disclosure is directed to a handheld power tool comprising a housing having a centerplane, a first side, and a second side opposite the first side; a switch extending through an opening in the housing, the switch comprising an elongated body having a center point, a first actuation surface at a first end extending from the first side of the housing, and a second actuation surface at a second end extending from the second side of the housing, the elongated body being movable within a range of motion extending from a first position wherein the center point of the elongated body is closer to the first side of the housing than the second side of the housing to a second position wherein the center point of the elongated body is closer to the second side of the housing than the first side of the housing; a first protrusion and a second protrusion disposed on the first side of the housing, each of the first and the second protrusions defining a protrusion surface facing away from the centerplane of the housing; a third protrusion and a fourth protrusion disposed on the second side of the housing, each of the third and the fourth protrusions defining a protrusion surface facing away from the centerplane of the housing, wherein when the elongated body is in the first position the first actuation surface extends no further from the centerplane of the housing than the further of the protrusion surfaces defined by the first and the second protrusions, and wherein when the elongated body is in the second position the second actuation surface extends no further from the centerplane of the housing than the further of the protrusion surfaces defined by the third and the fourth protrusions.

The above aspects of this disclosure and other aspects will be explained in greater detail below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
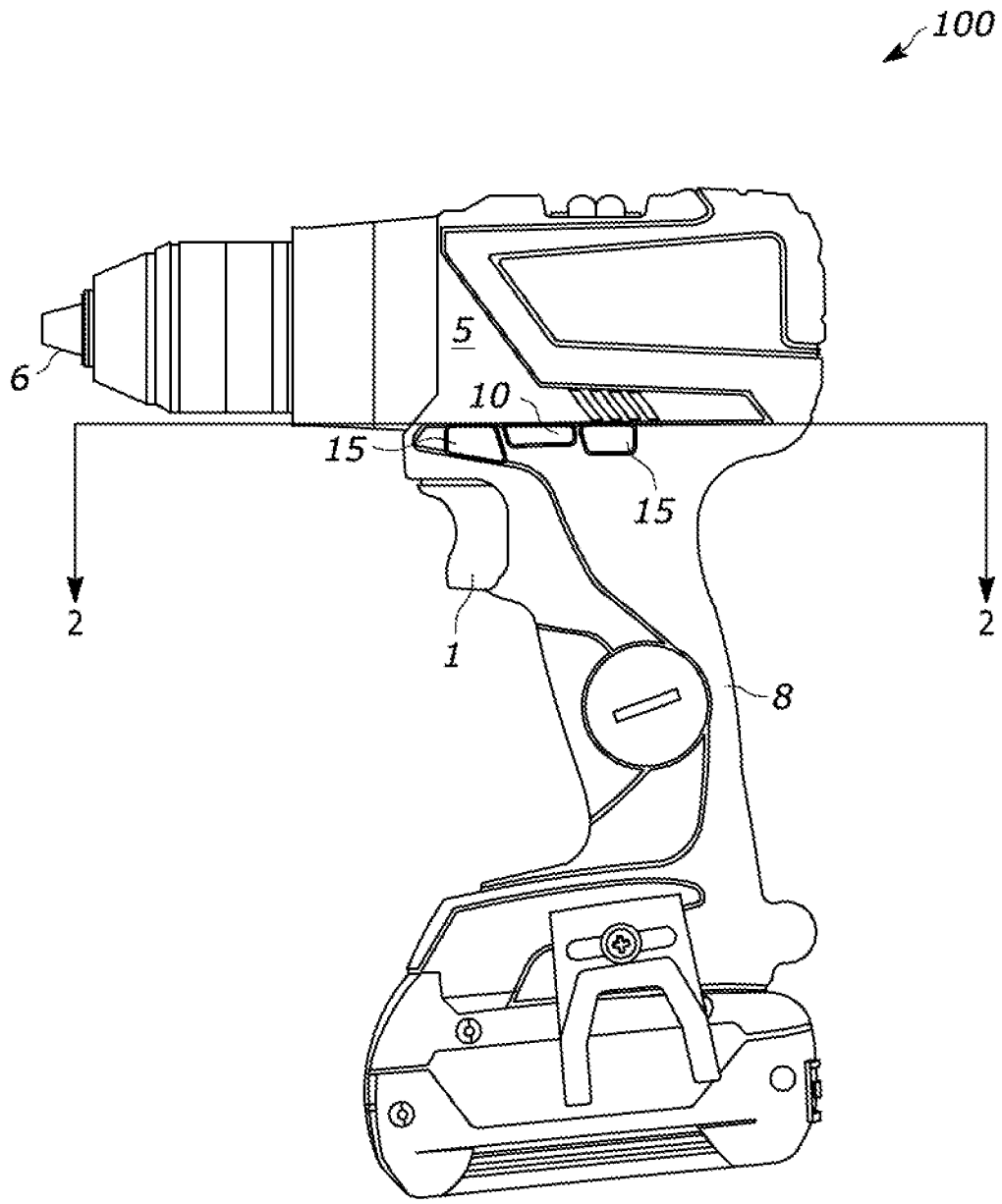
FIG. 1 is a side view of a handheld power tool equipped with a switch guard.
Figure 2A:
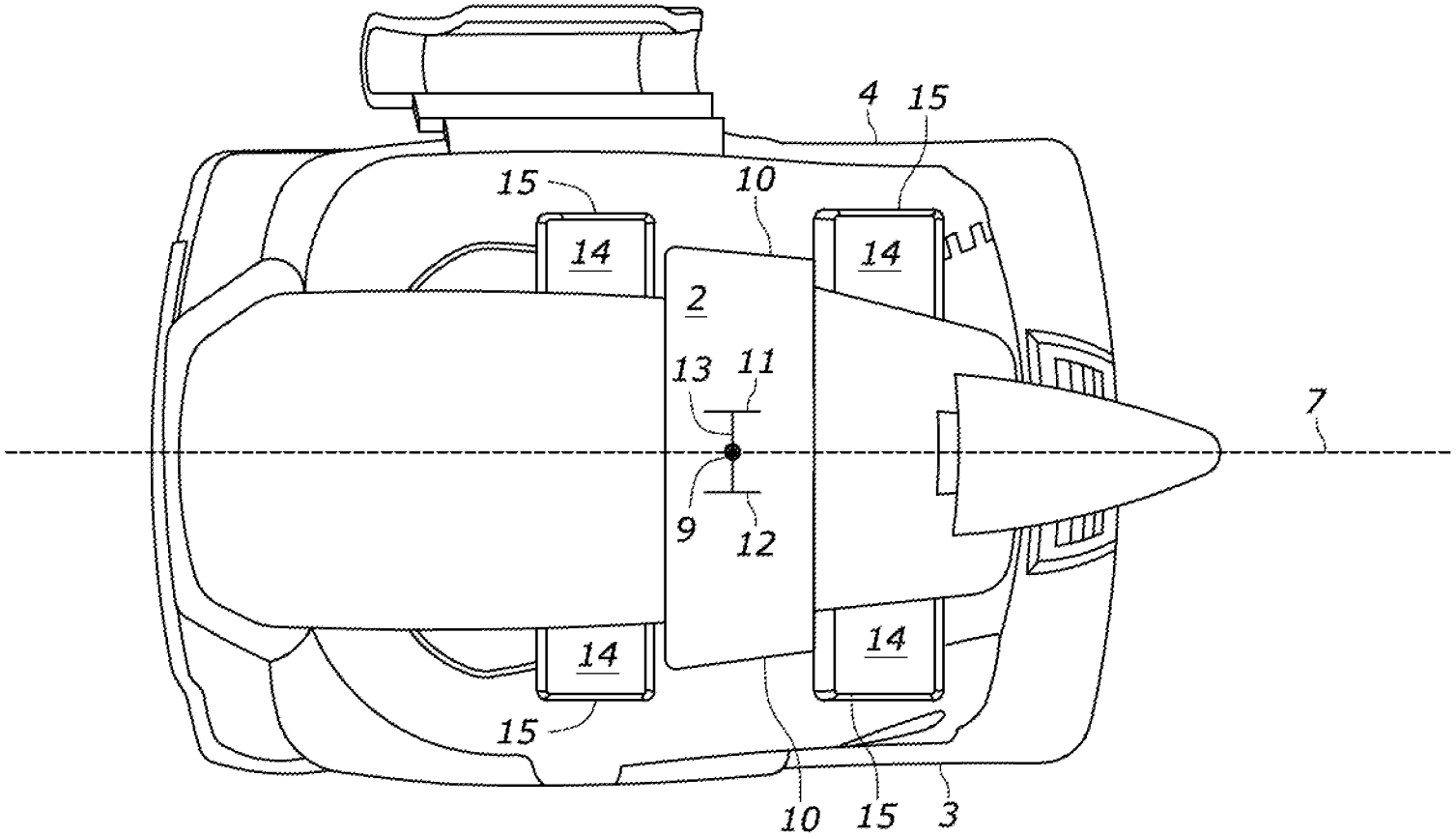
FIGS. 2*a*, 2*b*, and 2*c* provide top-down, sectioned views of a handheld power tool equipped with a switch guard, with the direction control switch in locked, reverse, and forward positions, respectively.
Figure 2B:
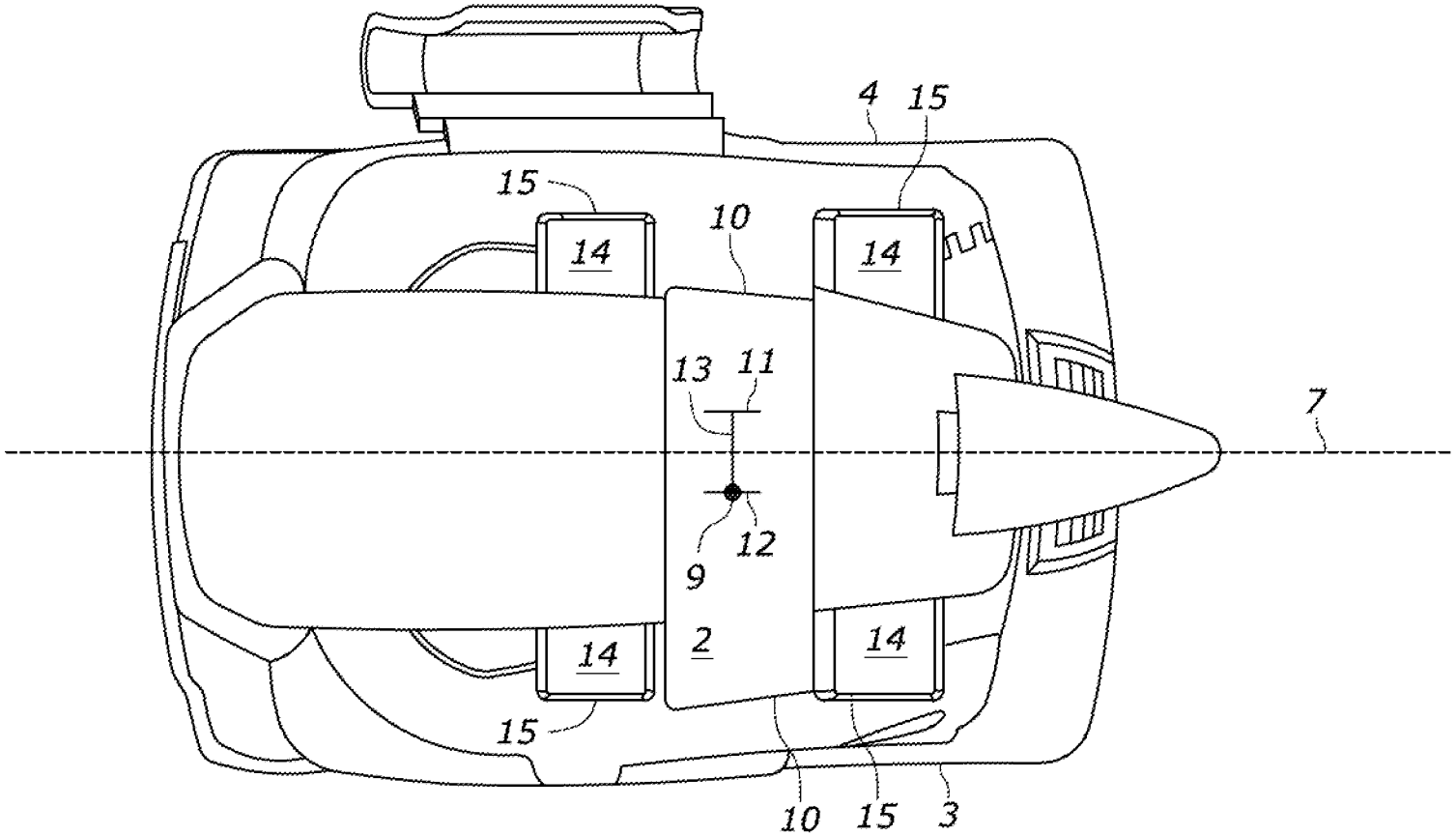
Figure 2C:
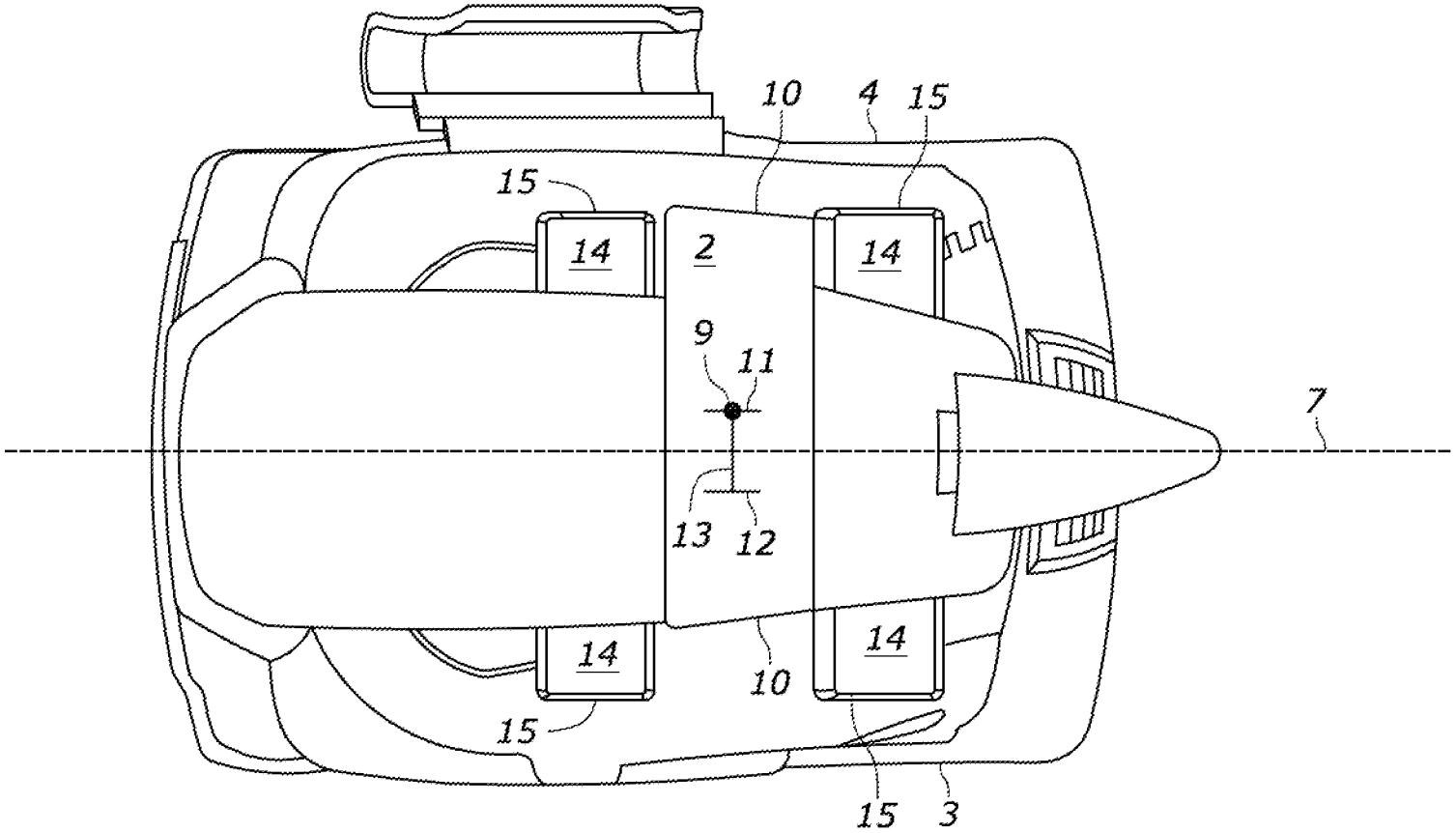

As shown in FIGS. 1, 2*a*, 2*b*, and 2*c*, a handheld power tool 100 consists of a generally pistol-shaped housing 5 where a user presses a trigger 1 to actuate the tool. The tool has an imaginary centerplane 7 running from the handle 8 through the chuck 6 of the tool. The tool contains a drive motor (not shown) that—when the trigger 1 is pressed—spins a chuck 6 of the tool either clockwise or counter-clockwise, depending on the position of a direction control switch 2. The direction control switch 2 extends through the housing 5 of the tool, from a right-hand side 3 of the tool to a left-hand side 4 of the tool.

The direction-control switch 2 consists of an elongated body having an imaginary center point 9 and an actuation surface 10 at each of its two ends. When a user presses on an actuation surface 10, the direction-control switch 2 slides in the direction the user is pressing until reaching the end of the switch's range of motion 13. The switch's range of motion 13 extends from a first position 11 (where the center point of the switch is located as far as possible towards the left-hand side 4 of the housing) to a second position 12 (where the center point of the switch is located as far as possible towards the right-hand side 3 of the housing). When the switch 2 is in the first position (see FIG. 2*c*), the drive motor spins clockwise (from the user's perspective) when the trigger is pressed. When the switch is in the second position (see FIG. 2*b*), the drive motor spins counter-clockwise (from the user's perspective) when the trigger is pressed. When the switch 2 is centered between the first position 11 and second position 12 (see FIG. 2*a*), the trigger 1 is locked.

A total of four switch guard protrusions 14 extend from the housing 5—two protrusions 14 on the right-hand side 3 and two protrusions 14 on the left-hand side 4. Each of the protrusions 14 defines a protrusion surface 15 at its end facing away from the centerplane 7 of the housing. On each of the left-hand side 4 and right-hand side 3 of the housing, the protrusions 14 are situated just to the front (towards of the chuck 6 end of the tool) and the rear (towards that handle 8 end of the tool) of the direction-control switch 2. The protrusions 14 extend far enough outward from the housing 5 that when the switch 2 is in its first position 11 or second position 12, the actuation surfaces 10 of the switch 2 do not extend further from the centerplane 7 of the housing 5 than the protrusion surfaces 15. In this way, the switch guard protrusions 14 prevent inadvertent pressing by the user of the direction-control switch 2 while the tool is in operation. Instead, the switch guard protrusions 14 compel the user to rearrange his or her grip and make a deliberate movement to press in the direction-control switch from either side of the tool.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A handheld power tool comprising:

a trigger;

a drive motor;

a housing having a centerplane, a first side, and a second side opposite the first side;

a switch extending through an opening in the housing, the switch comprising an elongated body having a center point, a first actuation surface at a first end extending from the first side of the housing, and a second actuation surface at a second end extending from the second side of the housing, the elongated body being movable within a range of motion extending from a first position wherein the center point of the elongated body is closer to the first side of the housing than the second side of the housing to a second position wherein the center point of the elongated body is closer to the second side of the housing than the first side of the housing;

a first switch guard disposed on the first side of the housing and comprising a first protrusion and a second protrusion, each of the first and the second protrusions extending from the housing and defining a protrusion surface facing away from the centerplane of the housing;

a second switch guard disposed on the second side of the housing and comprising a third protrusion and a fourth protrusion, each of the third and the fourth protrusions extending from the housing and defining a protrusion surface facing away from the centerplane of the housing, wherein when the elongated body is in the first position the first actuation surface extends no further from the centerplane of the housing than the further of the protrusion surfaces defined by the first and the second protrusions and, when the trigger is depressed, the drive motor spins in a clockwise direction, and wherein when the elongated body is in the second position the second actuation surface extends no further from the centerplane of the housing than the further of the protrusion surfaces defined by the third and the fourth protrusions, and when the trigger is depressed, the drive motor spins in a counter-clockwise direction.

* * * * *